US012378725B2

(12) United States Patent
Mediriyawaththa et al.

(10) Patent No.: US 12,378,725 B2
(45) Date of Patent: Aug. 5, 2025

(54) PERCOLATIVE SURFACE TEXTURED POLYMERIC LATEX COATING FOR A FABRIC SUPPORTED GLOVE AND METHOD OF MAKING

(71) Applicant: DIPPED PRODUCTS PLC, Colombo (LK)

(72) Inventors: Mediriyawaththage Don Nuwan Sujith Mediriyawaththa, Colombo (LK); Rendage Sachini Sandeepa Chandrasiri, Colombo (LK); Kannadeni Muhandiramalage Buddhika Prasanna Ariyarathna, Colombo (LK); Kuruppu Appuhamilage Sashika Kusal Hemachandra, Colombo (LK); Ratnayake Mudiyanselage Upul Nishantha Ratnayake, Colombo (LK)

(73) Assignee: DIPPED PRODUCTS PLC, Colombo (LK)

( * ) Notice: Subject to any disclaimer, the term of this patent is extended or adjusted under 35 U.S.C. 154(b) by 0 days.

(21) Appl. No.: 17/913,888

(22) PCT Filed: Sep. 21, 2021

(86) PCT No.: PCT/IB2021/058579
§ 371 (c)(1),
(2) Date: Sep. 23, 2022

(87) PCT Pub. No.: WO2022/064355
PCT Pub. Date: Mar. 31, 2022

(65) Prior Publication Data

US 2024/0011220 A1 Jan. 11, 2024

(30) Foreign Application Priority Data

Sep. 24, 2020 (LK) ..... 21360

(51) Int. Cl.
*D06N 3/18* (2006.01)
*A41D 19/00* (2006.01)
*D06N 3/00* (2006.01)

(52) U.S. Cl.
CPC ..... *D06N 3/183* (2013.01); *A41D 19/0065* (2013.01); *D06N 3/0052* (2013.01);
(Continued)

(58) Field of Classification Search
CPC ..... A41D 19/0065; B05D 1/02; B05D 1/18; B05D 2201/02; B05D 2203/00;
(Continued)

(56) References Cited

U.S. PATENT DOCUMENTS 7,771,644 B2 8/2010 Flather et al.
7,814,570 B2 10/2010 Hassan et al.
(Continued)

FOREIGN PATENT DOCUMENTS

EP 3023538 A1 5/2016
WO 2009/019554 A1 2/2009
WO 2016/141409 A1 9/2016

OTHER PUBLICATIONS

International Search Report and Written Opinion dated Dec. 21, 2021 which was issued in connection with PCT/IB2021/058579.

*Primary Examiner* — Hai Vo
(74) *Attorney, Agent, or Firm* — Buckley, Maschoff & Talwalkar LLC

(57) ABSTRACT

A latex dipped article, particularly a fabric supported glove which is flexible and fatigue resistant, comprising a fabric liner, with a shape of a hand. The fabric liner is coated with a foam polymeric latex material which is then treated with an aqueous silicone or non-silicon based surface active agent to facilitate the formation of percolative surface structure through bursting of bubbles in the foam layer and stripped
(Continued)

off the excess polymeric material. Then the stripped material is removed gently by exposing to a flowing fluid which further enhances the texture of the percolative coating that results an excellent grip in dry, wet and oil environments.

10 Claims, 4 Drawing Sheets

(52) U.S. Cl.
CPC ..... *D06N 3/0059* (2013.01); *D06N 3/007* (2013.01); *D06N 2205/04* (2013.01); *D06N 2205/24* (2013.01); *D06N 2207/06* (2013.01); *D06N 2209/126* (2013.01); *D06N 2211/103* (2013.01)

(58) Field of Classification Search
CPC ..... B05D 2518/10; B05D 2518/12; B05D 2520/05; B05D 2520/10; B05D 3/0254; B05D 3/107; D06M 15/643; D06M 15/693; D06N 2205/04; D06N 2205/24; D06N 2207/06; D06N 2209/126; D06N 2211/103; D06N 3/0052; D06N 3/0059; D06N 3/007; D06N 3/183
See application file for complete search history.

(56) References Cited

U.S. PATENT DOCUMENTS

| | | | | |
|---|---|---|---|---|
| 2009/0255033 | A1 | 10/2009 | Chen et al. | |
| 2010/0104750 | A1* | 4/2010 | Kassam ..... | A41D 19/0065 427/243 |
| 2015/0082508 | A1 | 3/2015 | Taylor et al. | |
| 2016/0183611 | A1 | 6/2016 | Dangalla et al. | |
| 2016/0263788 | A1* | 9/2016 | Loo ..... | B29C 67/20 |
| 2016/0360808 | A1 | 12/2016 | Flather et al. | |

* cited by examiner

PERCOLATIVE SURFACE TEXTURED POLYMERIC LATEX COATING FOR A FABRIC SUPPORTED GLOVE AND METHOD OF MAKING

FIELD OF THE INVENTION

The present invention relates to gloves and, more particularly, to fabric supported gloves with a thin, flexible and fatigue resistant percolative surface textured polymeric coating, which provides an excellent grip in dry, wet and oil environments and the method of making the gloves.

BACKGROUND

Enhanced grip and comfortability to the wearer are highly desirable properties of a glove. Most polymeric latex coated gloves are either fabric supported or unsupported and do not provide an enhanced grip that is suitable for different environmental conditions, especially in wet and oily conditions. The outer surface of the glove can be textured in order to obtain better gripping characteristics to the glove. The breathability and flexibility of the glove provides a greater comfort to the end-user. Conventionally, in most unsupported gloves, the outer surface texture is governed by former embossed patterns which can be varied according to the requirements of the glove manufacturer. However, this method results in high number of defects, including formation of pin holes, tearing and also results in less gripping characteristics especially in wet and oily conditions.

Another approach of surface texturizing is to produce a rough gripping outer surface by a post treatment process such as solvent treatment process, which results different crinkle/textured outer surfaces, especially for natural rubber latex gloves. Due to the roughness of the outer surface gripping performance improves, for the dry grip of the glove, but there is no significant improvement of gripping characteristics in wet and oily conditions. Drawbacks of solvent treatment processes are the safety problems related to fire risk as solvents are high flammable and reduction of glove properties due to swelling of polymeric material by solvents.

Another method of surface texturizing is embedding a layer of discrete particles, such as salt, into a previously formed polymeric latex layer and dissolving the discrete particles to leave the shape of the discrete particle texture on the outer surface of the glove. This is not favorable in manufacturing industries as salt has the tendency of rusting the metal compartments specially the dipping tanks.

Washing process is another approach of creating a surface texture which is made by removing the outermost un-gelled or un-coagulated surface of the polymeric latex foam coating using a pressurized fluid such as water. The resulting surface has a porous structure and contains anti-perspiring characteristics. However most of the uncoagulated polymeric materials are washed away with water during this process which will waste the material and cause environmental pollution.

Taking all the above factors into account, the present invention discloses a fabric supported glove with a thin, flexible and fatigue resistant percolative textured polymeric latex coating. The percolative surface texture is formed through a chemical process comprising treatment of foamed polymeric latex coating with an aqueous silicone or non-silicon based surface active agent. This chemical treatment process facilitates the mechanism of bursting bubbles in the foam layer, which results a flexible percolative texture. This novel method is more environmentally friendly and provides less number of defects compared to above mentioned methods.

PRIOR ART

U.S. Pat. No. 7,814,570 B2 refers to latex articles with a geometrically defined surface structure providing enhanced grip characteristics in dry, wet or oily environments made by applying polymeric coagulant coating, thereafter applying discrete coagulant particles, dipping the coated former into an aqueous latex emulsion, vulcanizing, stripping and dissolving the discrete coagulant particles in a suitable solvent or water to reveal the geometrically designed texture.

U.S. Pat. No. 7,771,644 B2 refers to a glove having a textured surface or textured foam coating produced by embedding a layer of discrete particles, such as salt, into a polymeric latex layer, gelling and curing the layer and dissolving the discrete particles to leave a textured or textured foamed surface.

Patent WO 2016/141409 A1 refers to a textured glove made by contacting a foamy aqueous solution of surfactant on the surface of the polymeric layer, the aqueous foam being in the process of collapsing during the contacting, wherein the aqueous solution of surfactant is effective to gel the polymeric material; applying an aqueous medium to the second surface with sufficient force or agitation to remove a portion of the polymeric material; curing the remaining polymeric material.

Patent EP 3 023 538 A1 refers to an antiperspirant glove which is made by providing a substrate; applying coagulant to a substrate; applying a foam of the polymeric material to the substrate; allowing the coagulant to coagulate some of the foam leaving part of the foam un-coagulated; and removing un-coagulated foam from the substrate to leave a layer of the coagulated polymeric material on the substrate. After the excess and partially coagulated foam is removed and dressing compositions may be applied to the garment material to provide an antiperspirant effect.

SUMMARY OF THE INVENTION

The present invention relates to a thin, flexible and fatigue resistant percolative surface textured polymeric latex coating, particularly a fabric supported glove, which provides an excellent grip in dry, wet and oily environments.

The percolative surface textured coating is formed by immersing a fabric liner into a coagulant solution, dip into a polymeric latex foam compound wherein foam compound comprises polymeric latex material particularly nitrile butadiene latex (NBR). Polymeric latex foamed compound deposited on the fabric liner is chemically treated with an aqueous silicone or non-silicon based surface active agent to facilitate the bubble bursting process and stripped off from the surface. The stripped polymeric latex material is then removed from the surface of the coating by exposing to a gently flowing fluid, preferably water. The coating consists of cell windows in the percolative structure which provides better breathability, flexibility and gripping characteristics in dry, wet and oily environments. The present invention further discloses the method of making of the percolative textured surface structure.

DESCRIPTION OF THE DRAWINGS

FIG. 1 shows a graphical representation of process steps of making the glove in which;

Figure 1:
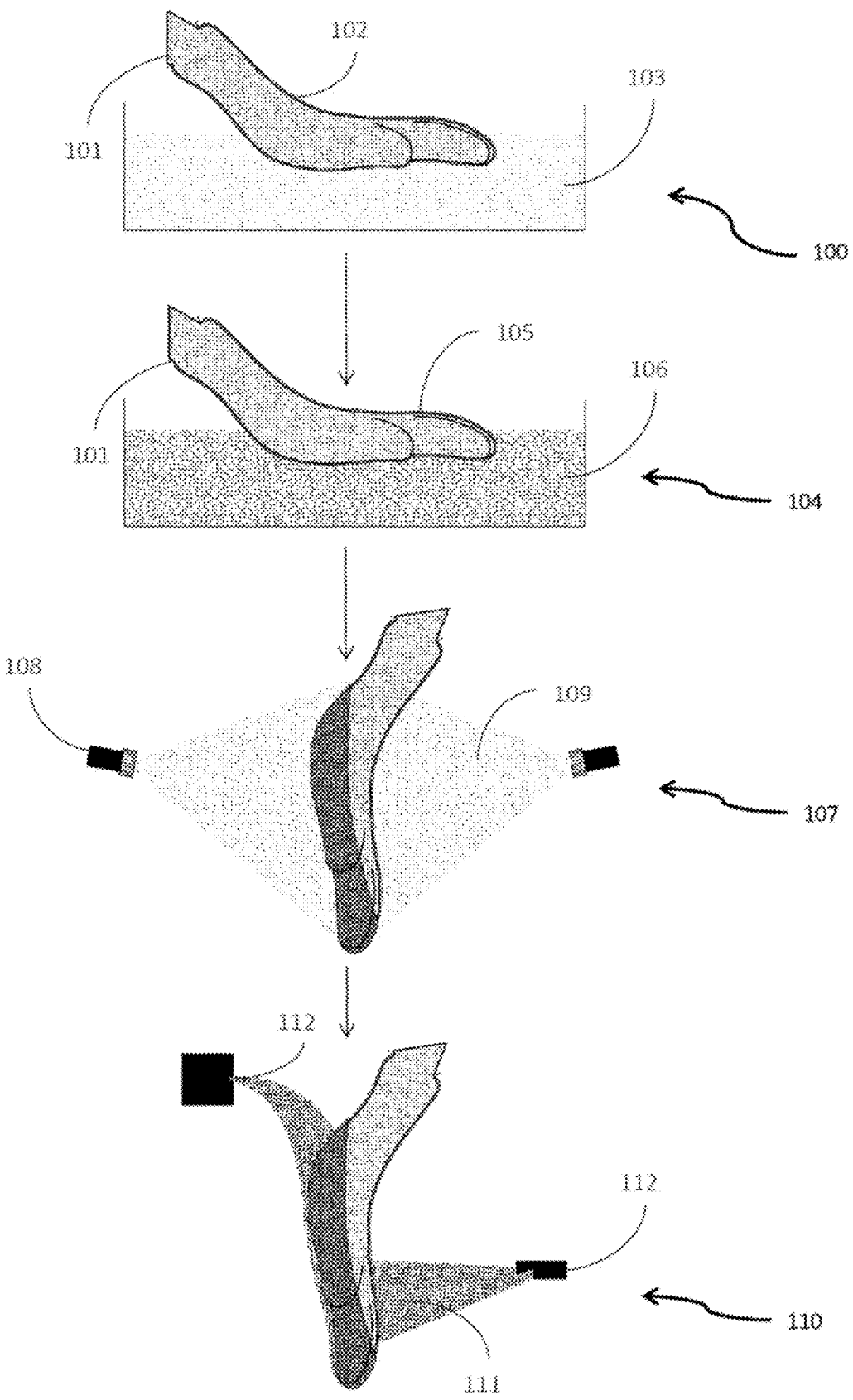

The method of making starts at the dipping station (100) by dipping the mould (101) with the dressed fabric liner (102) into a coagulant solution (103). In the next step 104, the coagulant coated fabric liner (105) is dipped in to a foamed polymeric compound (106) and then at 107 spray station using a spray nozzle (108), an atomized aqueous silicone or non-silicon based surface active agent (109) is sprayed onto the surface of the foamed coating. In the final step 110, stripped polymeric latex material is removed by a gently flowing fluid (111) using a water shower unit (112).

Figure 2A:
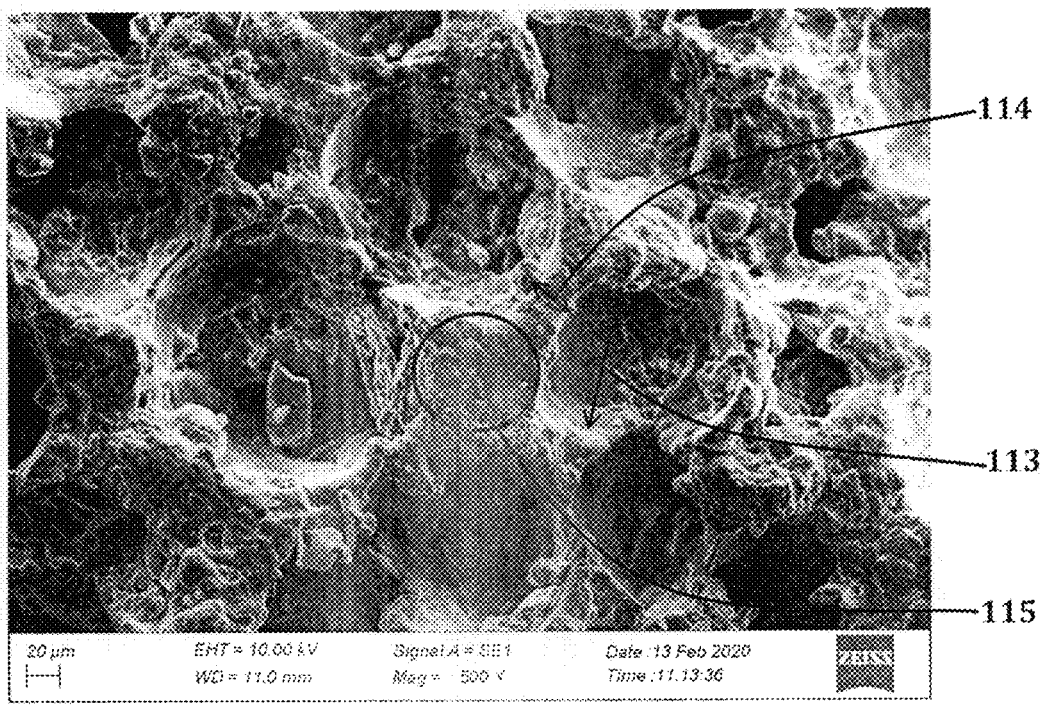
Figure 2B:
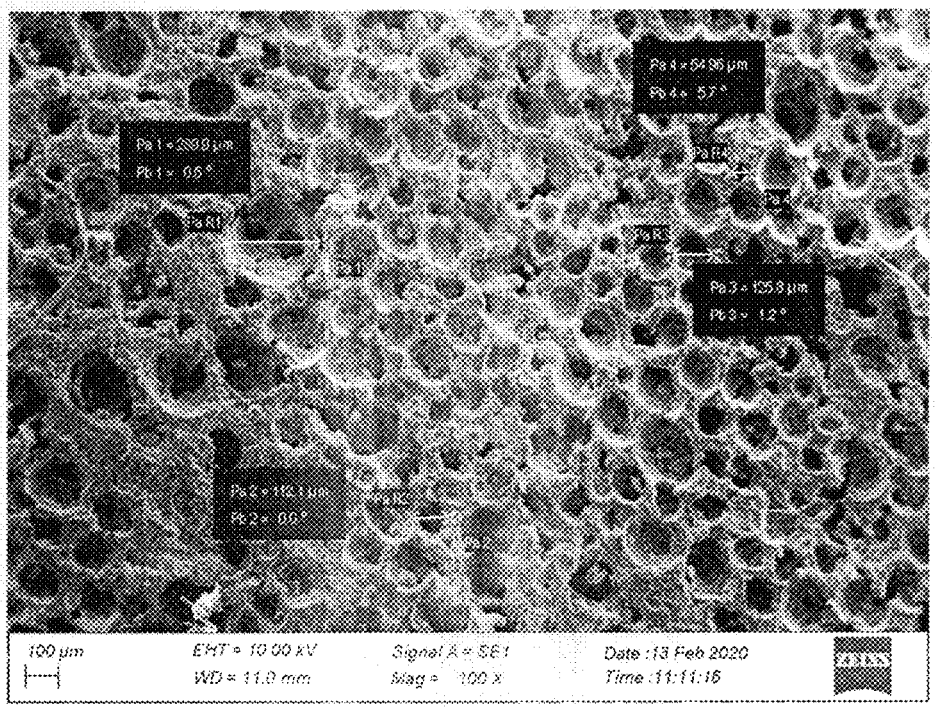

FIG. 2*a* is a Scanning Electron Microscopic (SEM) image of the percolative surface texture of the glove at 500× magnification showing the spherical cell windows (113), struts (114) and strut joints (115) in the outer polymeric latex coating. FIG. 2*b* is a SEM image of the percolative structure at 100× magnification.

Figure 3:
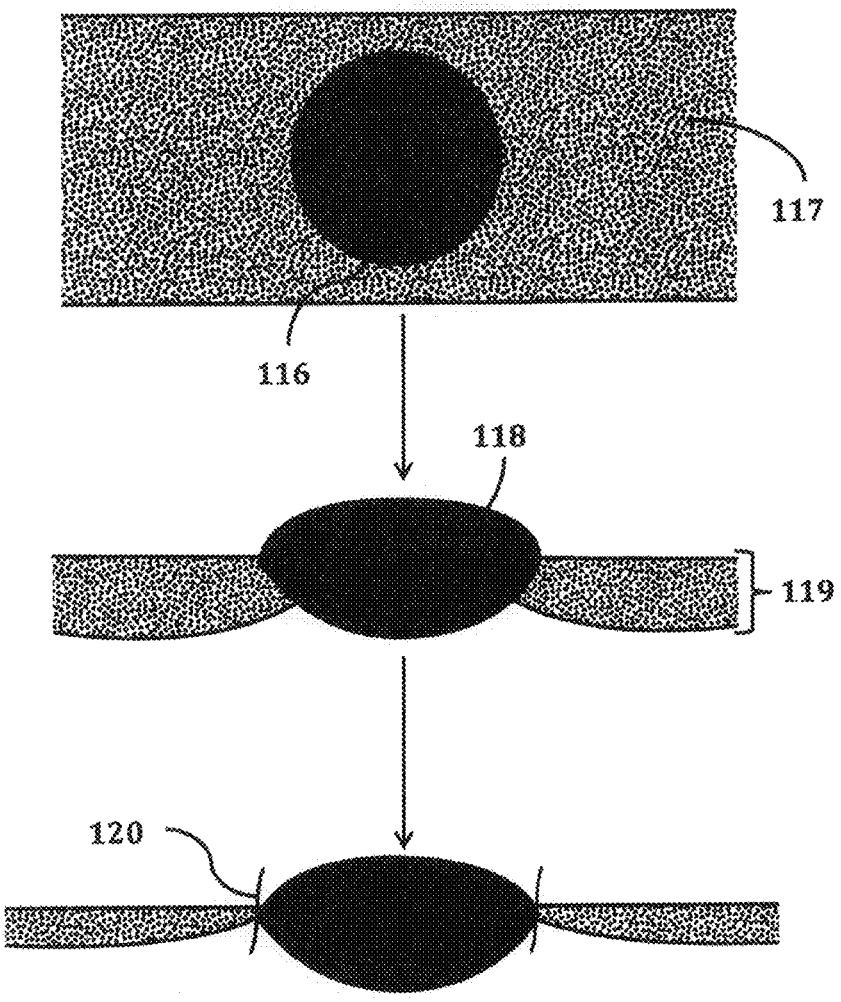

FIG. 3 is a graphical representation of the bridging-dewetting mechanism of the silicone or non-silicon based surface active agent.

Figure 4:
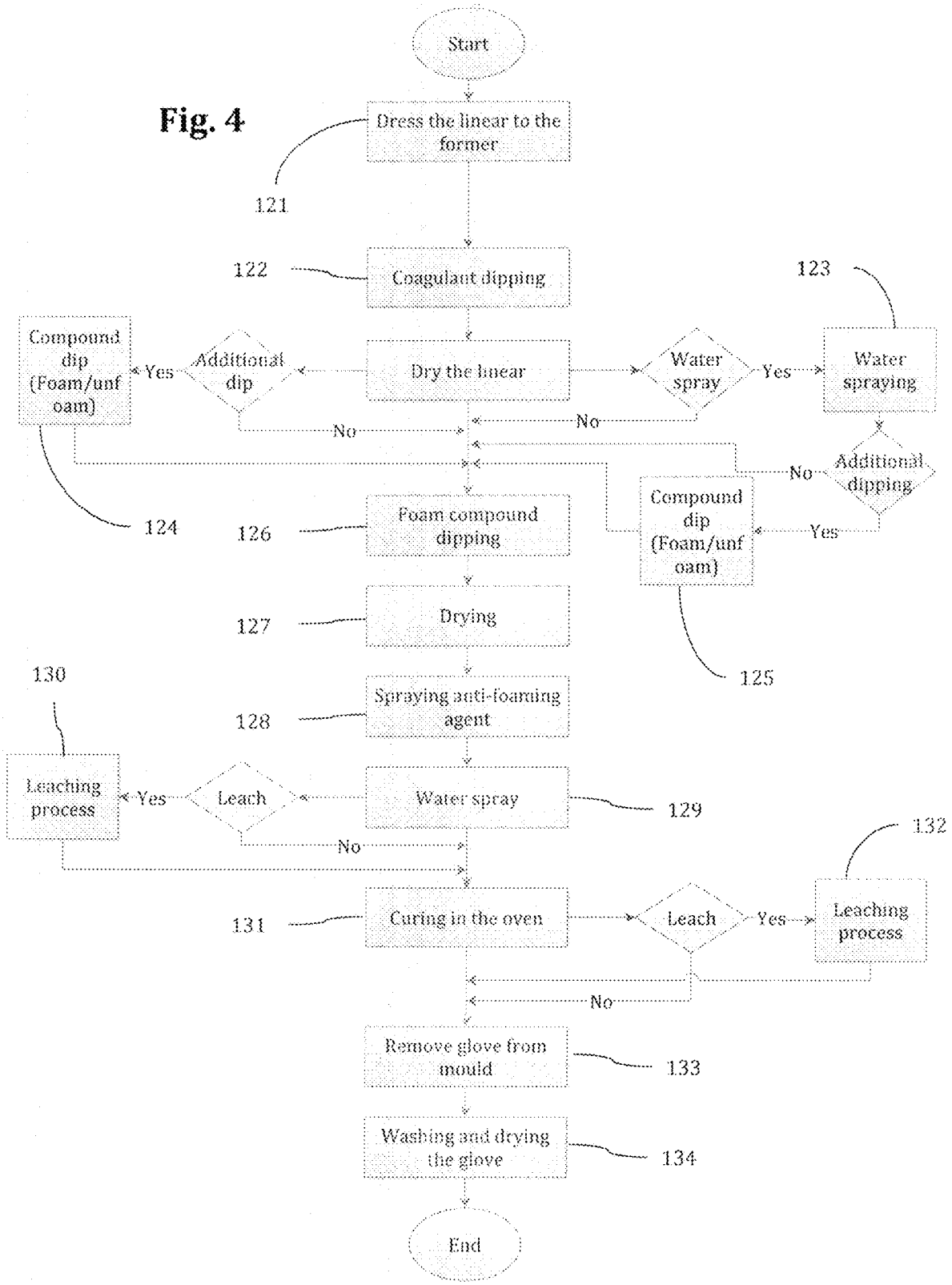

FIG. 4 is the flowchart for the method of making the textured percolative polymeric latex coating according to the present invention.

DETAILED DESCRIPTION OF THE INVENTION

The present invention relates to a thin, flexible and fatigue resistant percolative textured polymeric latex coating, particularly a fabric supported glove which provides an excellent grip in dry, wet and oily environments.

The Percolative Surface Structure

The percolative structure referred herein consists of foam skeletons with spherical shape and cell windows (113) in open form. The cell windows have diameters within the range 0.01-1.00 mm, more preferably 0.03-0.50 mm and most preferably 0.05-0.30 mm. The cell walls are separated from each other by struts with a length of 0.03-0.06 mm and strut joints. Gases are allowed to penetrate through the cell windows to the inner side of the glove and thereby provide enhanced breathability. Furthermore, the percolative nature provides an excellent grip performance in dry, wet and oily conditions. The micro roughness on the surface of the struts (114) and strut joints (115), increase the contact surface area and thereby improves the dry grip. The wet and oily grip is improved by the absorption of fluids into the cell windows of the percolative structure. The percolative structure is applied as a thin coating thereby providing improved flexibility.

Process of Making the Percolative Structure

As illustrated in FIG. 1, initially the fabric liner (102) is dressed to a mould (101) and immersed in a coagulant solution (103). The coagulant coated fabric liner (105) is then immersed in a foamed polymeric latex compound (106) which creates a foamed latex layer on top of the fabric liner.

Thereafter, the surface of the foam coating is chemically treated with an aqueous silicone or non-silicon based surface active agent (109) to facilitate bubble bursting. The chemical treatment comprises of an atomized spraying of silicone or non-silicon based surface active agent into the foam layer which as a result creates a uniform percolative structure. The atomized spray is deposited on the foam layer as a mist and breaks the latex bubbles in the foam layer. The atomized spray will only collapse the cell wall of the foam which is open to the atmosphere and will not penetrate through. This is due to the chemical reaction between the foam and added silicone or non-silicone based surface active agent. In contrast, if the foam is dipped in to an aqueous silicone or non-silicone based surface active agent, the additional pressure will break the total cell wall of the foam through penetration, which will collapse the whole foam layer and will not result any percolative structure with cell windows. The same phenomena will occur if the silicone or non-silicone based surface active agent is sprayed with high pressure. Therefore, it is imperative to maintain a maximum pressure of around 0.5 bar. After the chemical treatment with the surface active agent, the stripped polymeric material is removed by exposing to a gently flowing fluid (111) for example water. As a result, a thin, highly breathable, flexible and fatigue resistant coating remains on the fabric liner. Foam polymeric coating may be a full dip, half dip or palm dip according to the requirement, but it's not limited to above mention dip levels.

Another embodiment of the present invention is that; the dipped article comprises one or more nitrile butadiene layers beneath the percolative structure. Initially the fabric liner is dressed to a mould and immersed in a coagulant solution. The coagulant coated fabric liner is then immersed in a polymeric latex compound which creates a latex layer on top of the fabric liner. Then latex coated fabric liner is immersed in a foamed polymeric latex compound which creates a foamed latex layer on top of the polymeric latex layer. Thereafter, the surface of the foam coating is chemically treated by spraying atomized aqueous silicone or non-silicon based surface active agent to facilitate bubble bursting. The atomized spray is deposited on the foam layer as a mist and breaks the latex bubbles in the foam layer and stripped off. The stripped polymeric material is then removed by exposing to a gently flowing fluid.

It may have one or more leaching processes before curing the glove. The water requirement of the present invention is considerably low due to the chemical treatment with the silicon or non-silicone based surface active agent.

The foam coated layer, which is disposed on the fabric liner, is cured at 80 to 120° C. temperature for 30 to 90 minutes and thereafter it may have one or more leaching steps. The curing temperature may have to be controlled since higher temperature may degrade the fabric liner. The cured glove is allowed to cool and removed from the former. The glove may consist of one or more layers as per the required properties of the final glove.

The polymeric latex compound includes latex as the base polymer, sulfur, accelerators, activators to facilitate vulcanization; stabilizers to stabilize the latex particles in the aqueous dispersion, thickeners to increase the viscosity of the compound, foaming agent to facilitate the foaming, etc.

The polymeric latex material comprising natural latex, and synthetic latex selected group of carboxylated or non-carboxylated nitrile butadiene latex (NBR), polychloroprene latex (CR), styrene-butadiene copolymer (SBR), polyurethane latex (PU), polyacrylate, butyl rubber, polyvinyl chloride (PVC), polyvinylacetate, polyethylene, silicon rubber, fluoroelastomers or combinations thereof.

The silicone or non-silicon based surface active agents usually consists of oils such as plant oils, hydrocarbons and solvents such as glycerin, propylene glycol. The silicone based material can be and not limited to silicone oil, organo-modified siloxanes or polydimethylsiloxane. Non silicone based surface active agent can be and not limited to fatty alcohol, ethylene oxide or propylene oxide fatty acid soaps or esters. The effective concentration of an aqueous silicone or non-silicon based surface active agent is in the range of 0.1-10%, more preferably the in range of 0.5-5.0%, most preferably in the range of 1.0-3.0%.

Mechanism of Making the Percolative Structure

The bubble bursting of the latex foam structure is followed by the bridging-dewetting mechanism as in FIG. 3. When spraying the aqueous silicone or non-silicon based surface active agent on to the coated latex foam layer, the oil droplets (116) enter to the bubble wall (117) which connects two or more bubbles together and forms a lens (118). Then the oil droplet connects two film surfaces and forms a bridge called "oil bridge" (119), the bridge is unstable due to the capillary forces and the film ruptures (120). Due to rupturing, bubbles are broken and the outermost coating starts to strip off and drip through the surface of the coating, leaving an open cell windows in the polymeric latex coating which results a percolative surface texture on the glove. Stripped material is then removed by exposing to a gently flowing fluid such as water. The thickness of resulting outer polymeric latex layer is approximately 0.08-0.20 millimeters.

The size of spherical shaped cell windows on the latex coating can be increased based on the treatment of aqueous silicone or non-silicon based surface active agent. The bursting of bubble walls produces combined bubbles and results in a distribution of different sized cell windows. The cell window diameter of the percolative latex coating is in the range of 10-500 microns, more preferably in range of 30-400 microns, most preferably in range of 50-300 microns. The number of cell windows per unit area is in the range of 30-80 per $mm^2$ more preferably in range of 40-70 per $mm^2$ and most preferably in range of 50-60 per $mm^2$. The cell window size of the percolative structure depends on the fineness of the spray of the aqueous silicone or non-silicon based surface active agent. Hence the aqueous silicone or non-silicon based surface active agent spray is atomized by injecting nozzles and deposited on the foam layer as a mist. Using highly pressurized aqueous silicone or non-silicon based surface active agent results in increased cell window diameter. Hence the silicone or non-silicon based surface active agent is sprayed onto the foam layer with a maximum pressure of 0.5 bar. The resultant structure of percolative coating of the ultimate product will be completely different if the foam layer is immersed in a solution of silicone or non-silicone based surface active agent instead of atomized spraying. The concentration of the aqueous silicone or non-silicon based surface active agent affects the cell window diameter of the percolative layer where the cell window diameter increases with the increase of concentration. These cell windows cover 30-70% of the total surface area of the foam coating thus improves the breathability and flexibility Glove Making Process FIG. 4 depicts the glove making process.

At Step 121, the liner fabric (102) is dressed to a mould (101) with a shape of a hand. The mould may be composed of metal, ceramic, fiberglass and plastic or combination thereof.

A wide range of materials may be used as the fabric liner 102, for example, spandex, cotton, wool, rayon, nylon, lycra, polyester, aramid, dyneema, acrylic, carbon conductive fiber, copper conductive fiber, thunderon conductive fiber, multifilament yarn spun, nylon 6, nylon 66, para and meta aramids such as Kevlar, ultra-high molecular weight polyethylene, high-performance polyethylene (HPPE) or any blend of these fibers and materials and combination thereof. Fabric liner can be selected depending on the requirements of the glove.

At step 122, mould 101 with the dressed fabric liner 102 is dipped into a coagulant solution 103 at room temperature or at higher temperatures. Coagulant solution 103 can be an aqueous solution of dissolved electrolytes such as calcium nitrate or electrolytes dissolved in a solvent water mixture. The coagulant solution 103 may comprise of calcium nitrate or at least one type of salt selected from the group consisting of calcium salts or ammonium salts.

At step 123, the fabric liner may be wetted by spraying water to control the penetration of latex compound through the fabric liner to the inner side. At steps 124 and 125, it may have one or more additional dips of the polymeric latex foam coating to get additional properties to the finished glove.

At step 126, the coagulant coated liner is dipped into a polymeric latex foamed compound 106, where the foam compound comprises, 86.0% Nitrile butadiene latex
0.4% Stabilizers
1.7% Soap
0.9% Sulphur
4.3% ZnO
1.3% Accelerators
1.0% Pigments
0.3% Viscosity modifiers
3.4% Wax
0.6% Antioxidant Compounded polymeric latex material is foamed after keeping 24-72 hours of maturation time. The viscosity of the foamed compound is controlled in the range of 2000-9000 cP (Brookfield viscometer, spindle −2, rpm −0.2) at 25° C., more preferably in range of 4000-7000 cP), most preferably in range of 5000-6000 cP. The stabilized foam compound consists of bubbles with a diameter in the range of 0.01-1.00 mm, more preferably 0.03-0.50 mm, most preferably in the range of 0.05-0.30 mm. The density of the foam polymeric latex compound material needs to be controlled over time within the range of 10-30 $gcm^{-3}$, more preferably within 15-25 $gcm^{-3}$, most preferably within 18-22 $gcm^{-3}$. The foam layer thickness is mainly controlled by the foam density and the viscosity of the polymeric material.

Mechanical and chemical foaming referred herein is the process of generating air bubbles within the latex compound through a mechanical action like agitation or a chemical reaction which produces gas by adding gas releasing agents/blowing agents.

At step 127, the coated foam layer is dried for 30-150 s. The drying time may vary with the viscosity of the polymeric foam compound.

At step 128, the coated polymeric foam layer is chemically treated with an atomized aqueous silicone or non-silicon based surface active agent by spraying as a mist. The silicone or non-silicon based surface active agent needs to spray onto the foam layer with a pressure below 0.5 bar.

An effective concentration of aqueous silicone or non-silicon based surface active agent is in the range of 0.1%-10%, more preferably 0.5%-5.0%, most preferably 1.0%-3.0%. The cell window diameter of the percolative structure may increase with the concentration of the aqueous silicone or non-silicon based surface active agent. The spray nozzles are aligned to the mould to ensure uniform spraying on all over the foam coating. At step 129, the stripped polymeric materials are removed by exposing to a gently flowing fluid.

The fluid comprises of water or diluted solution of solvent or diluted electrolytes such as calcium nitrate The gelled or partially gelled glove may be dried for around 5-10 min at 25° C. Alternatively at step 130, the gelled glove may be dipped into heated water at a temperature of 50-60° C. to leach out the residual calcium nitrate and other water soluble chemicals.

At step 131, the glove is cured in an oven with a temperature around 80-120° C. for approximately 30-90 minutes. Overheating may damage or degrade the fabric material.

At step 132, it may have another leaching step to further leach out the residual materials At step 133, the cured glove is allowed to cool and is then stripped off from the former.

At step 134, the cured glove may go through an additional washing and drying process to further improve the properties.

Grip Test

A grip test is used to measure the grip performance of the glove. In the grip test, the force required to lift a vertically suspended cylindrical metal bar having a polished surface is measured. The grip force is measured by weights of counterbalance loaded. The maximum load that can withstand without any slippage of the metal surface is the final results of the test. This test can be performed to measure the dry, wet and oil grip of the glove by treating the metal surface with an oil or water layer. The grip test results are shown in Table 1.

TABLE 1

Results of the grip test

| | Dry grip/kg | Wet grip/kg | Greasy oil/kg |
|---|---|---|---|
| Percolative surface textured glove | 10.145 (Maximum) | 10.145 (Maximum) | 4.165 |
| Conventional nitrile foam glove | 10.145 (Maximum) | 3.365 | 3.165 |

The test result of grip test as shown in Table 1, shows that the percolative surface texture provides excellent grip for, when handling dry, wet and oil conditions.

The invention claimed is:

1. A latex article with a thin, flexible percolative structure comprising:

an outer polymeric latex layer comprising a foamed polymeric latex material with a plurality of latex bubbles; and an inner layer of fabric material, comprising natural and synthetic fibers, the outer polymeric latex layer being disposed onto the fabric material;

wherein the outer polymeric layer is chemically texturized by spraying atomized aqueous silicone or non-silicone based surface active agent onto the foamed polymeric latex material with a maximum pressure of 0.5 bar that collapses cell walls of the latex bubbles without penetrating through to form spherical cell windows, followed by removing the stripped polymeric latex material from the outer polymeric layer by a gently flowing fluid to produce a percolative structure on the outer polymeric layer that includes a distribution of the spherical cell windows having an average diameter in a range of 10 microns to 50 microns surrounded with struts and strut joints.

2. The latex article of claim 1, wherein the outer polymeric layer is formed as a thin latex film disposed over the fabric material.

3. The latex article of claim 1, wherein the outer polymeric layer comprises a latex material selected from a group consisting of carboxylated or non-carboxylated nitrile-butadiene latex, natural latex, polychloroprene latex, styrene-butadiene copolymer, polyurethane latex, polyacrylate, butyl rubber, polyvinylchloride, polyvinylacetate, polyethylene, silicon rubber, fluoroelastomer and any combinations thereof.

4. The latex article of claim 1, wherein the inner layer of fabric material includes at least one of: spandex, cotton, wool, rayon, nylon, polyester, acrylic, carbon conductive fiber, copper conductive fiber, organic conductive fiber, multifilament yarn spun, nylon 6, nylon 66, para and meta aramids, ultra-high molecular weight polyethylene, high-performance polyethylene (HPPE) and any combinations thereof.

5. The latex article of claim 1, wherein a thickness of the outer polymeric latex layer is approximately 0.08-0.20 millimeters.

6. The latex article of claim 1, wherein the fluid used to remove the stripped latex material comprises one of water, diluted solution of solvent, and diluted electrolytes.

7. The latex article of claim 1, wherein the percolative structure comprises one of 30 to 80 cell windows per $mm^2$, 40 to 70 cell windows per $mm^2$, and 50-60 cell windows per $mm^2$.

8. The latex article of claim 1, wherein the latex article is formed of a fabric supported latex dipped glove.

9. The latex article of claim 1, wherein the silicone or non-silicone based surface active agent comprises at least one of: silicone oil, organo-modified siloxanes or polydimethylsiloxane, fatty alcohol, ethylene oxide or propylene oxide fatty acid soaps or esters.

10. The latex article of claim 1, wherein for the silicone or non-silicone based surface active agent the useful concentration is in the range of one of: 0.1-10% by volume, 0.5-5.0% by volume, and 1.0-3.0% by volume.

* * * * *